US007915547B2

(12) United States Patent
Otani et al.

(10) Patent No.: US 7,915,547 B2
(45) Date of Patent: Mar. 29, 2011

(54) KEY SWITCH, INPUT DEVICE, CONTACT PATTERN

(75) Inventors: Kazumi Otani, Kyoto (JP); Yoshihide Sakano, Kyoto (JP); Kazuo Yoneyama, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 341 days.

(21) Appl. No.: 12/222,426

(22) Filed: Aug. 8, 2008

(65) Prior Publication Data

US 2009/0050464 A1 Feb. 26, 2009

(30) Foreign Application Priority Data

Aug. 23, 2007 (JP) ..... 2007-217084

(51) Int. Cl.
*H01H 25/04* (2006.01)

(52) U.S. Cl. ..... 200/6 A; 200/5 R

(58) Field of Classification Search ..... 200/5 R, 200/6 A, 511, 512, 517, 5 A; 341/20–22; 345/156, 157, 160, 161, 163, 168, 169
See application file for complete search history.

(56) References Cited

U.S. PATENT DOCUMENTS

| | | | | | |
|---|---|---|---|---|---|
| 4,085,306 | A | * | 4/1978 | Dunlap | 200/275 |
| 4,987,275 | A | * | 1/1991 | Miller et al. | 200/5 A |
| 5,536,911 | A | * | 7/1996 | Madill | 200/6 A |
| 5,555,004 | A | * | 9/1996 | Ono et al. | 345/161 |
| 5,605,223 | A | * | 2/1997 | Gutmann et al. | 200/275 |
| 5,621,196 | A | * | 4/1997 | Nishijima et al. | 200/6 A |
| 5,691,517 | A | * | 11/1997 | Yamamoto et al. | 200/6 A |
| 5,810,604 | A | * | 9/1998 | Kopp et al. | 434/317 |
| 6,153,843 | A | | 11/2000 | Date et al. | |
| 6,448,518 | B1 | * | 9/2002 | Martin et al. | 200/292 |
| 6,723,930 | B2 | * | 4/2004 | Minami | 200/6 A |
| 7,030,329 | B1 | * | 4/2006 | Sneek et al. | 200/292 |
| 7,528,338 | B2 | * | 5/2009 | Ataka | 200/517 |

FOREIGN PATENT DOCUMENTS

| | | | |
|---|---|---|---|
| DE | 43 01 928 | A1 | 7/1994 |
| EP | 0 656 640 | A1 | 6/1995 |
| EP | 1 478 001 | A1 | 11/2004 |
| JP | 10-308141 | | 11/1998 |

OTHER PUBLICATIONS

Extended European Search Report dated Feb. 2, 2010 issued in corresponding European Application No. 08014137.7-1231.

* cited by examiner

*Primary Examiner* — Michael A Friedhofer
(74) *Attorney, Agent, or Firm* — Nixon & Vanderhye P.C.

(57) ABSTRACT

A key switch comprises: a plurality of conductive portions which are respectively positioned in dispersed directions from a center of a key top; and contact patterns provided on a print substrate, which respectively face the conductive portions. The contact patterns each have, in a conductive portion facing area thereof, at least four separate lands, and the at least four lands include: a first land and a second land which are separated by a first gap provided on a first reference line which extends from a position facing the center of the key top in the direction of the center of the conductive portion facing area; a third land which is separated from the first land by a second gap provided at a position which is distant from the first reference line in one direction; and a fourth land which is separated from the second land by a third gap provided at a position which is distant from the first reference line in another direction.

12 Claims, 18 Drawing Sheets

PRIOR ART

PRIOR ART

KEY SWITCH, INPUT DEVICE, CONTACT PATTERN

CROSS REFERENCE TO RELATED APPLICATION

The disclosure of Japanese Patent Application No. 2007-217084, filed Aug. 23, 2007, is incorporated herein by reference.

BACKGROUND

1. Field of the Technology

The present technology relates to a key switch to be used in an information processing apparatus or the like, and particularly to contact patterns provided on a print substrate of a key switch.

2. Description of the Background Art

A movable rubber contact is often used for a cross-key switch of a remote controller of an electronic device or a controller of a computer game apparatus (e.g., Japanese Laid-open Patent Publication No. 10-308141). FIG. 21 shows a movable rubber contact 91 of a conventional cross-key switch. FIG. 21(*a*) is a plain view; FIG. 21(*b*) is a bottom view; and FIG. 21(*c*) is a cross-sectional view. The movable rubber contact 91 has a cross-key shaped top portion 93 protruding upwards from the center of a base portion 92, and a bottom end peripheral portion of the cross-key shaped top portion 93 is continuous with the base portion 92 via a thin skirt portion 94. On a back surface of the cross-key shaped top portion 93, a center shaft 95 which acts as a rocking-movement fulcrum is provided, and protrusions 96 are respectively formed at head portions of four XY directions, which protrusions are formed so as to protrude downwards. Conductive rubber contacts 97 are respectively and integrally formed on bottom end faces of the four protrusions 96.

FIG. 22 is a local cross-sectional view of a controller including the movable rubber contact 91. FIG. 23 shows fixed contacts 99 provided on a circuit substrate 98. As shown in FIG. 23, each fixed contact 99 comprises two electrode patterns 99*a* and 99*b* which are formed so as to be separate from each other. Each fixed contact 99 is brought into conduction when the two electrode patterns thereof are contacted by a corresponding conductive rubber contact 97 in a straddling manner, whereby a switch of said each fixed contact 99 is turned ON. The four conductive rubber contacts 97 of the movable rubber contact 91 mounted on the circuit substrate 98 respectively face four fixed contacts 99 provided on the circuit substrate 98. Above the cross-key shaped top portion 93, a round-shaped key top 100 is mounted such that the skirt portion 94 or the base portion 92 may not be touched by a finger. When any one of up, down, left and right positions of a top surface of the key top 100 is pressed, the key top 100 and the cross-key shaped top portion 93 integrally rock with respect to the center shaft 95, and one of the conductive rubber contacts 97 provided at the head portions contacts a corresponding one of the fixed contacts 99 on the circuit substrate 98, and thereby the corresponding one of the fixed contacts 99 is brought into conduction. FIG. 24 shows a conduction mechanism of a fixed contact 99. As described above, when one of the conductive rubber contacts 97 contacts a corresponding fixed contact 99 on the circuit substrate 98 in a straddling manner, the electrode patterns 99*a* and 99*b* thereof are brought into electrical conduction. By bringing the fixed contact 99 into conduction in this manner, a direction input can be detected, whereby XY coordinate control by a cursor, vertical/horizontal scrolling on a display screen, and the like are enabled.

However, the above-described cross-key switch disclosed by Japanese Laid-open Patent Publication No. 10-308141 has a problem described below. For example, when the key top of a game pad or the like is pressed in a diagonal direction at 45 degrees toward a position between fixed contacts 99, it is detected that ON inputs have been performed at the same time to switches of the fixed contacts 99 which are present on both sides of the direction, and then data indicating the diagonal direction is outputted FIG. 25 illustrates an example which shows areas of fixed contacts 99, which areas are contacted by conductive rubber contacts 97 in the case where the key top is pressed diagonally upward left at 45 degrees. As shown in FIG. 25, when a sufficient pressing force is applied to the key top, the conductive rubber contacts 97 respectively contact a fixed contact 99 of the up direction and a fixed contact 99 of the left direction such that each conductive rubber contact 97 contacts corresponding electrode patterns in a straddling manner, and switches of both the fixed contacts are turned on.

However, for example, in a player-versus-player fighting game or the like, there is a case where a player is required to quickly perform a complex direction input operation in order to execute a special blow. When such a quick operation is performed, there is a case where a pressing force applied to the key top for an input of a diagonal direction is not sufficient. FIG. 26 illustrates an example which shows areas of fixed contacts 99, which areas are contacted by conductive rubber contacts 97 in the case where the pressing force applied to the key top is not sufficient when the key top is pressed diagonally upper left. In the case of FIG. 26, the areas contacted by the conductive rubber contacts 97 are smaller than in the case of FIG. 24 due to the insufficient pressing force. Accordingly, the conductive rubber contacts 97 each do not contact corresponding electrode patterns 99*a* and 99*b* in a straddling manner. Consequently, the switches of the fixed contacts 99 are not turned on. Therefore, even though the player performs an input of the diagonal direction, the input is not detected. Thus, there is a problem that an input intended by the player is not detected by an input device such as a game pad or the like.

SUMMARY

Therefore, a feature of the example embodiment presented herein is to provide a key switch and contact patterns for detecting a direction input, which enable more precise detection of a direction input which is performed by a pressing force applied toward a position between fixed contacts.

The present example embodiment has the following features to achieve the above.

A first aspect of the present example embodiment is a key switch comprising: a key top (2); a plurality of conductive portions (31) which are respectively positioned in dispersed directions from a center of the key top; and a plurality of contact patterns (41) provided on a print substrate, which are respectively provided in conductive portion facing areas (426) respectively facing the conductive portions, which key switch is capable of detecting conduction caused by a contact between any one of the contact patterns and a corresponding one of the conductive portions which faces said any one of the contact patterns. The contact patterns each have at least four separate lands (411*a* to 411*d*) in a corresponding one of the conductive portion facing areas, and the at least four lands include: a first land (411*a*) and a second land (411*b*) which are separated by a first gap (421) provided on a first reference line which extends from a position facing the center of the key top in a direction of a center of the corresponding one of the conductive portion facing areas; a third land (411*c*) which is separated from the first land by a second gap (422) provided at a position which is distant from the first reference line in one direction; and a fourth land (411*d*) which is separated from the second land by a third gap (423) provided at a position which is distant from the first reference line in another direction.

According to the first aspect of the present example embodiment, even in the case where an area of a contact pattern, which area is contacted by an elastic body conductive portion, is small, a circuit of the contact pattern can be brought into conduction. As a result, in the case where such a direction input as to press a plurality of contact patterns at the same time, e.g., a diagonal direction input by a cross key, is performed, the direction input can be more precisely detected.

In a second aspect of the present example embodiment, the second gap is provided on a second reference line extending from the center of the corresponding one of the conductive portion facing areas in a direction which forms, with the first reference line, a predetermined angle between 30 degrees and 60 degrees.

According to the second aspect, even in the case where the area of the contact pattern, which area is contacted by the elastic body conductive portion, is small due to a weak pressing force, the conduction of the circuit of the contact pattern can be more securely obtained. Consequently, such a direction input as to press a plurality of contact patterns at the same time can be more precisely detected.

In a third aspect of the present example embodiment, the predetermined angle is 45 degrees.

In a fourth aspect of the present example embodiment, the first gap is an area which extends along the first reference line.

In a fifth aspect of the present example embodiment, the second gap is an area which extends along the second reference line.

In a sixth aspect of the present example embodiment, the at least four lands are formed such that an outer area, which is positioned at a far side, of the corresponding one of the conductive portion facing areas, as seen from the position facing the center of the key top, is divided into at least four portions.

In a seventh aspect of the present example embodiment, the second gap and the third gap re provided in symmetrical positions with respect to the first reference line.

According to the third to seventh aspects of the present example embodiment, the same effects as those of the first and second aspects can be obtained.

An eighth aspect of the present example embodiment is an input device having a key switch comprising: a key top (2) a plurality of conductive portions (31) which are respectively positioned in dispersed directions from a center of the key top; and a plurality of contact patterns (41) provided on a print substrate, which are respectively provided in conductive portion facing areas respectively facing the conductive portions, which key switch is capable of detecting conduction caused by a contact between any one of the contact patterns and a corresponding one of the conductive portions which faces said any one of the contact patterns. The contact patterns each have at least four separate lands in a corresponding one of the conductive portion facing areas, and the at least four lands include: a first land and a second land which are separated by a first gap (421) provided on a first reference line which extends from a position facing the center of the key top in a direction of a center of the corresponding one of the conductive portion facing areas; a third land which is separated from the first land by a second gap (422) provided at a position which is distant from the first reference line in one direction; and a fourth land which is separated from the second land by a third gap (423) provided at a position which is distant from the first reference line in another direction.

A ninth aspect of the present example embodiment is a key switch comprising: a key top; a plurality of conductive portions (31) which are respectively positioned in dispersed directions from a center of the key top; and a plurality of contact patterns (41) provided on a print substrate, which are respectively provided in conductive portion facing areas respectively facing the conductive portions, which key switch is capable of detecting conduction caused by a contact between any one of the contact patterns and a corresponding one of the conductive portions which faces said any one of the contact patterns. The contact patterns each have, in an outer area which is positioned at a far side, of the corresponding one of the conductive portion facing areas, as seen from a position facing the center of the key top, at least a plurality of gaps (421, 422, 423) and a plurality of lands which are separated from each other by the plurality of gaps.

According to the eighth and ninth aspects, the same effect as that of the first aspect can be obtained.

In a tenth aspect of the present example embodiment, the contact patterns each have at least three gaps provided therein. A first gap is provided on a first reference line extending from the position facing the center of the key top in a direction of a center of the corresponding one of the conductive portion facing areas, such that the first gap is divided by the first reference line, and a second gap and a third gap are provided at both sides of the first gap.

According to the tenth aspect, even in the case where the area of the contact pattern, which area is contacted by the elastic body conductive portion, is small due to a weak pressing force, the conduction of the circuit of the contact pattern can be more securely obtained. Consequently, such a direction input as to press a plurality of contact patterns at the same time can be more precisely detected.

An eleventh aspect of the present example embodiment is a key switch comprising; a key top; a plurality of conductive portions (31) which are respectively positioned in dispersed directions from a center of the key top; and a plurality of contact patterns (41) provided on a print substrate, which are respectively provided in conductive portion facing areas respectively facing the conductive portions, which key switch is capable of detecting conduction caused by a contact between any one of the contact patterns and a corresponding one of the conductive portions which faces said any one of the contact patterns. The contact patterns each have: a set of lands which are separate from each other so as to be brought into conduction when the key top is pressed at a position at which a corresponding one of the conductive portions is present; and a set of lands which are separate from each other so as to be brought into conduction when the key top is pressed at a position between the plurality of conductive portions.

A twelfth aspect of the present example embodiment are contact patterns respectively provided in conductive portion facing areas respectively facing a plurality of conductive portions respectively positioned in dispersed directions from a center of a key top. The contact patterns each have at least four separate lands (411*a* to 411*d*) in a corresponding one of the conductive portion facing areas, and the at least four lands include: a first land (411*a*) and a second land (411*b*) which are separated by a first gap provided on a first reference line which extends from a position facing the center of the key top in a direction of a center of the corresponding one of the conductive portion facing areas; a third land (411*c*) which is separated from the first land by a second gap provided at a position which is distant from the first reference line in one direction; and a fourth land (411*d*) which is separated from the second land by a third gap provided at a position which is distant from the first reference line in another direction.

According to the eleventh and twelfth aspects, the same effect as that of the first aspect can be obtained.

According to the above aspects, a direction input performed by a pressing force applied to a position between fixed contacts can be more precisely detected.

These and other features, aspects and advantages of the present example embodiment will become more apparent from the following detailed description of the present example embodiment when taken in conjunction with the accompanying drawings.

DESCRIPTION OF THE PREFERRED EMBODIMENTS

Hereinafter, an embodiment of the present example embodiment will be described with reference to the drawings. Note that, the present example embodiment presented herein is not limited to this embodiment.

Figure 1:
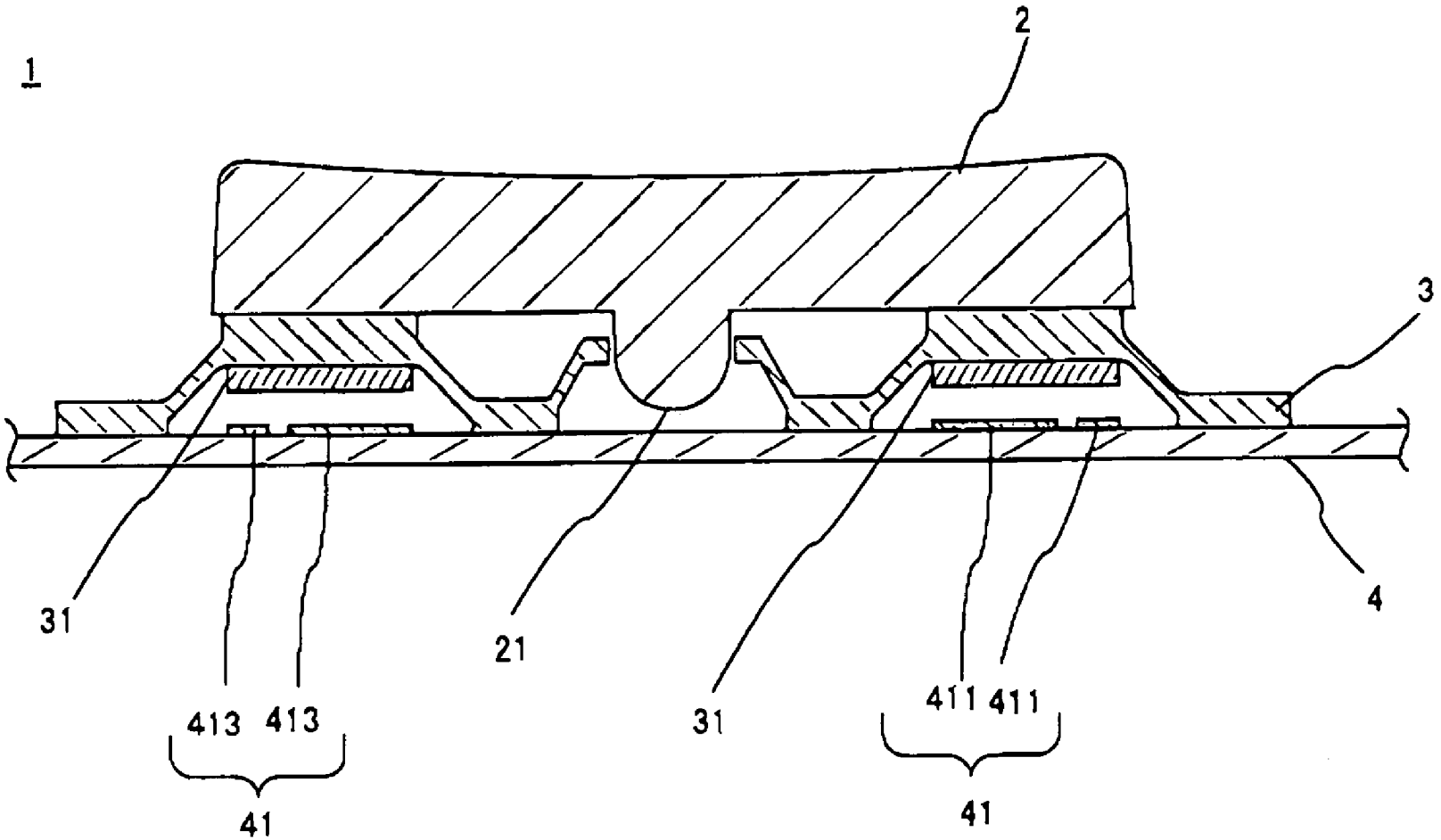
FIG. 1 is a cross-sectional view showing a fundamental structure of a key contact part to be used in a key switch input device according to an embodiment.

FIG. 1 is a cross-sectional view showing a fundamental structure of a key contact part to be used in a key switch input device of the present embodiment. In FIG. 1, the key contact part comprises: a key top 2; a key rubber 3 provided on a bottom surface of the key top 2, which moves downward in accordance with pressing down of the key top 2; and conductive rubbers 31 integrally formed with the key rubber 3. Below these, a print substrate 4 is provided. Contact patterns 41, each of which is structured with a plurality of electrode lands, are respectively formed at positions facing the conductive rubbers provided above the print substrate 4.

Figure 2:
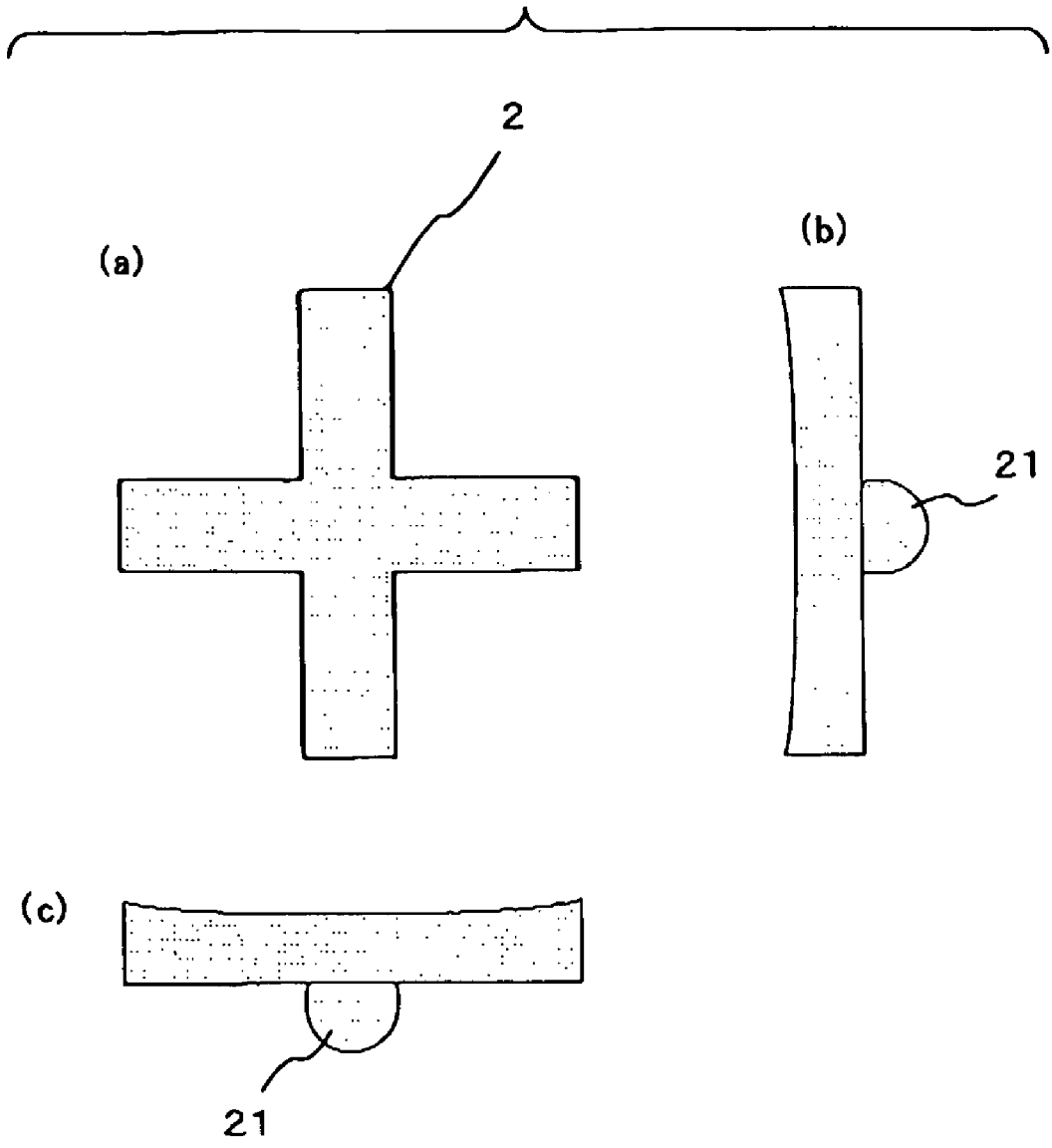
FIG. 2 shows a key top 2 in detail.

FIG. 2 shows the key top 2 in detail. FIG. 2(*a*) is a plain view of the key top 2; FIG. 2(*b*) is a right side view; and FIG. 2(*c*) is a front view. The key top 2 has a cross shape which is formed with, e.g., resin. On a back surface of the key top 2, a center shaft 21 which acts as a rocking-movement fulcrum is formed so as to protrude downward.

Figure 3:
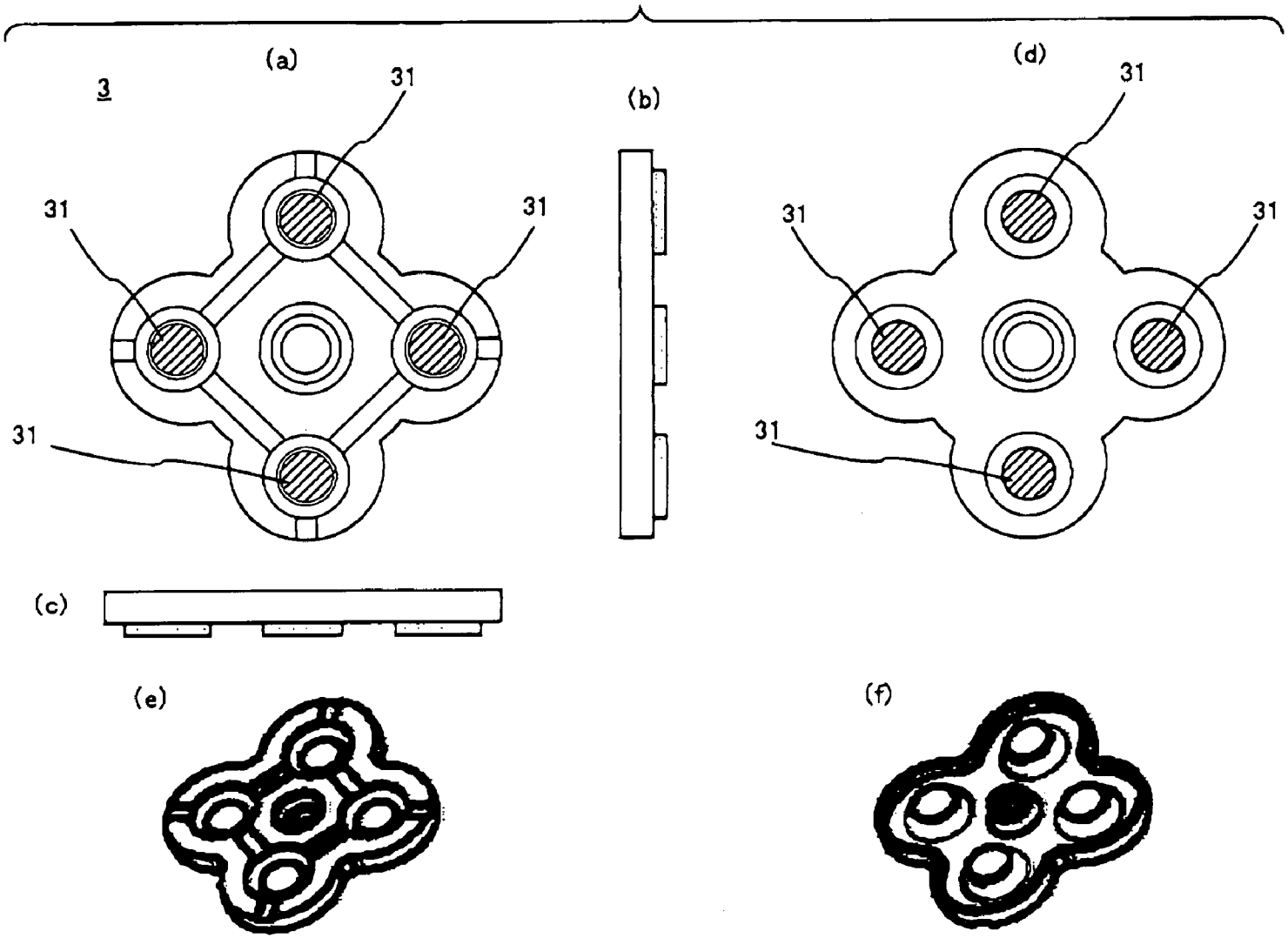
FIG. 3 shows a key rubber 3 in detail.

FIG. 3 shows in detail the key rubber 3 shown in FIG. 1. FIG. 3(*a*) is a plain view; FIG. 3(*b*) is a right side view; FIG(c) is a front view; and FIG(d) is a bottom view. FIG. 3(*e*) is a perspective view of the key rubber 3 seen from the front side thereof, and FIG. 3(*f*) is a perspective view of the key rubber 3 seen from the bottom side thereof. The key rubber 3 is formed with non-conductive synthetic rubber such as silicon rubber or the like, and attached to the key top 2. On the key rubber 3, a plurality of circular conductive rubbers 31 are provided. The conductive rubbers 31 are provided such that when the key top 2 is mounted, the conductive rubbers 31 are positioned so as to respectively align with four-direction head portions of the key top 2. The conductive rubbers 31 are formed so as to have adequate elasticity. Therefore, when a top surface of the key top 2 is pressed at any position other than the center thereof (e.g., any of four-direction head portions), the key top 2 rocks with respect to the center shaft 21, and thereby a conductive rubber 31 at the pressed position contacts a corresponding contact pattern 41 on the print substrate 4. As a result, a circuit of the corresponding contact pattern 41 is brought into conduction (i.e., ON input is performed thereon). Further, for example, when the key top 2 is pressed at the up and left positions thereof at the same time (i.e., diagonally upper left direction input), the contact pattern provided at the up direction and the contact pattern provided at the left direction are respectively contacted by corresponding conductive rubbers 31, and circuits of the two contact patterns of the up and left directions are brought into conduction at the same time. When the pressing is ceased, the key top returns to the original position thereof, and the conduction of the contact patterns is cancelled.

Figure 4:
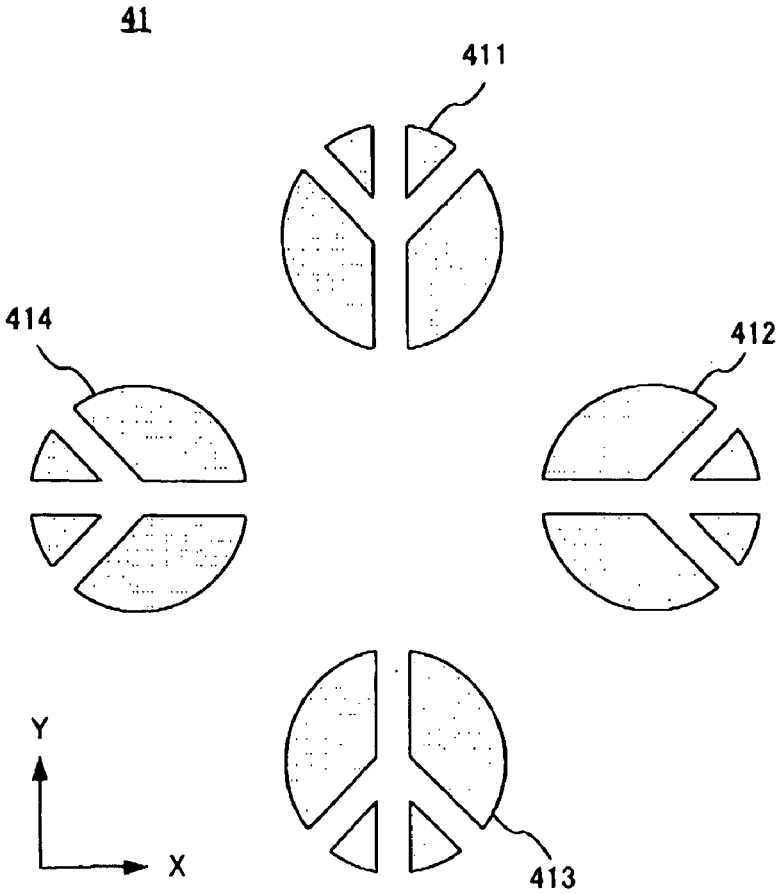
FIG. 4 shows contact patterns 41.

FIG. 4 shows the contact patterns 41 formed on the print substrate 4. FIG. 4 shows four contact patterns 411 to 414 respectively corresponding to four directions, i.e., up, down, left and right directions. As described above, the contact patterns are formed at positions which respectively face the conductive rubbers. By having a later-described circuit structure, the contact pattern 411 can detect an input of the up direction (in other words, act as a switch circuit for the up direction input). Also, the contact pattern 412 can detect an input of the right direction; the contact pattern 413 can detect an input of the down direction; and the contact pattern 414 can detect an input of the left direction. In the present embodiment, in addition to the four directions of up, down, left and right directions, an input of a diagonal direction toward a position between contact patterns can be detected. For example, when ON inputs are performed on the contact patterns 411 and 414 at the same time, an input of a diagonally upper left direction can be detected. Also, when ON inputs are performed on the contact patterns 412 and 413 at the same time, an input of a diagonally lower right direction can be detected.

Figure 23:
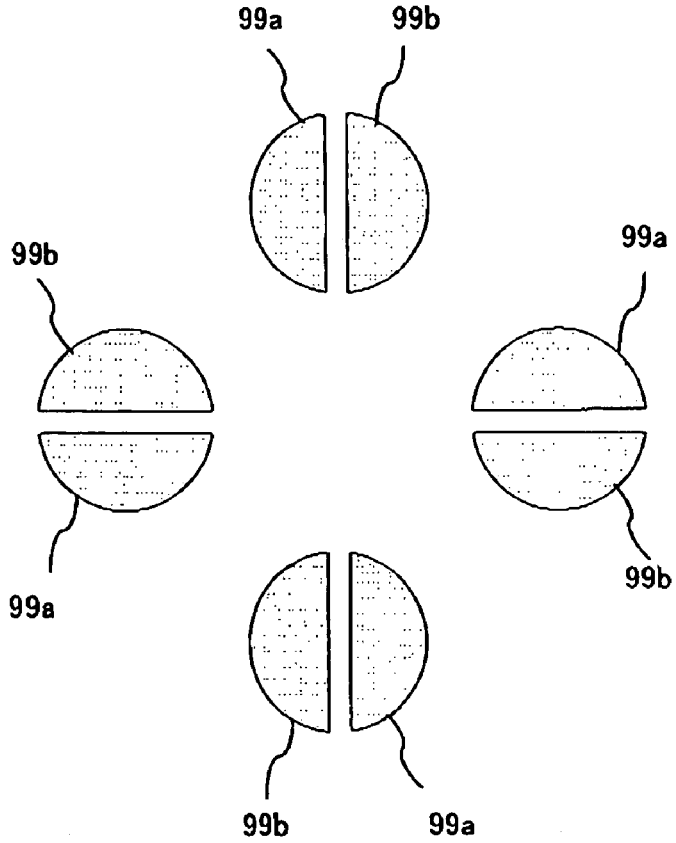
PRIOR ART FIG. 23
FIG. 23 shows fixed contacts.
Figure 24:
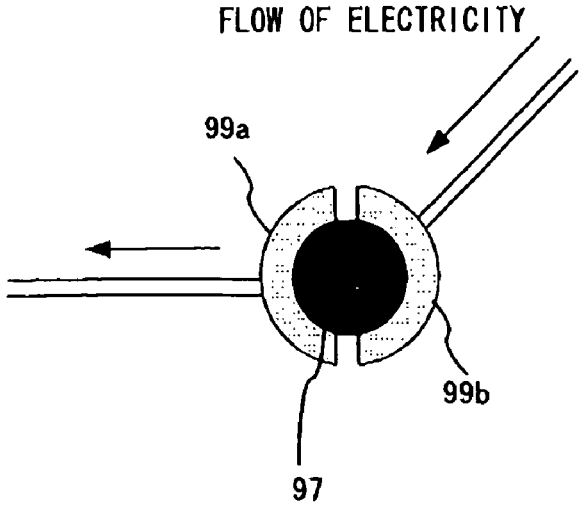
FIG. 24 PRIOR ART
FIG. 24 shows a conduction mechanism of a fixed contact.
Figure 25:
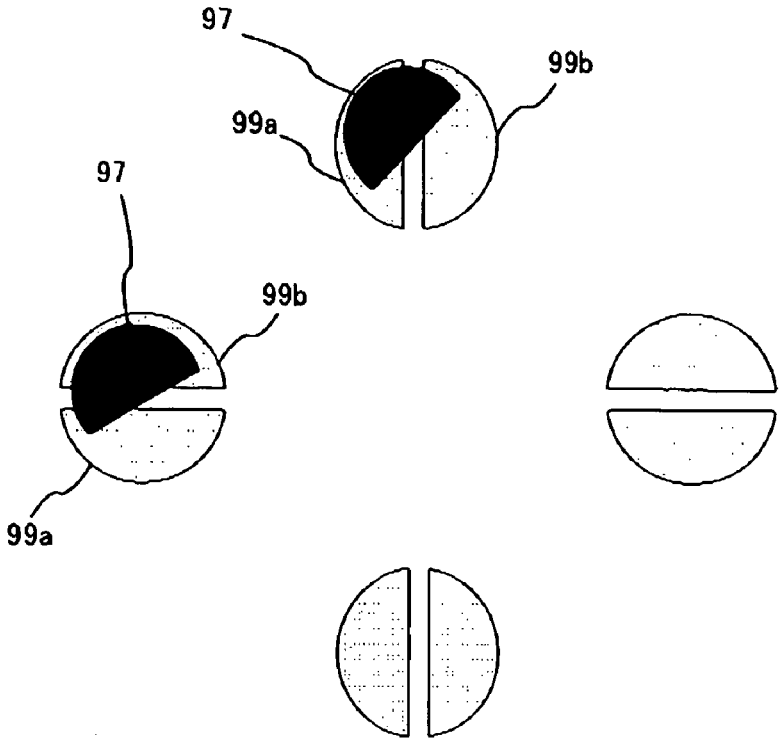
FIG. 25 illustrates an example which shows areas of fixed contacts, which areas are contacted by conductive rubbers.
Figure 26:
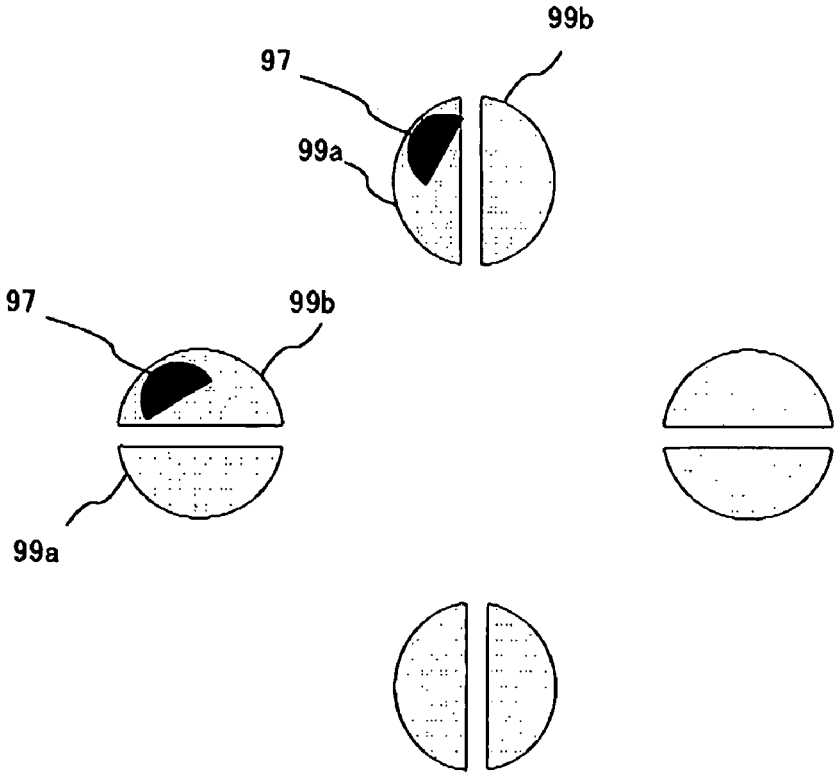
FIG. 26 illustrates an example which shows areas of fixed contacts, which areas are contacted by conductive rubbers.

As shown in FIG. 23, in the conventional cross-key switch, when a conductive rubber which is a conductive body contacts two electrode lands (i.e., fixed contact 99) on a print substrate, the electrode lands facing the conductive rubber are brought into conduction, whereby an ON input is outputted. On the other hand, in the present embodiment, four electrode lands (hereinafter, referred to as contact lands) are provided for each single contact pattern. Hereinafter, a structure of a contact pattern will be described in detail by taking, as an example, the contact pattern 411 for detecting an input of the up direction.

Figure 5:
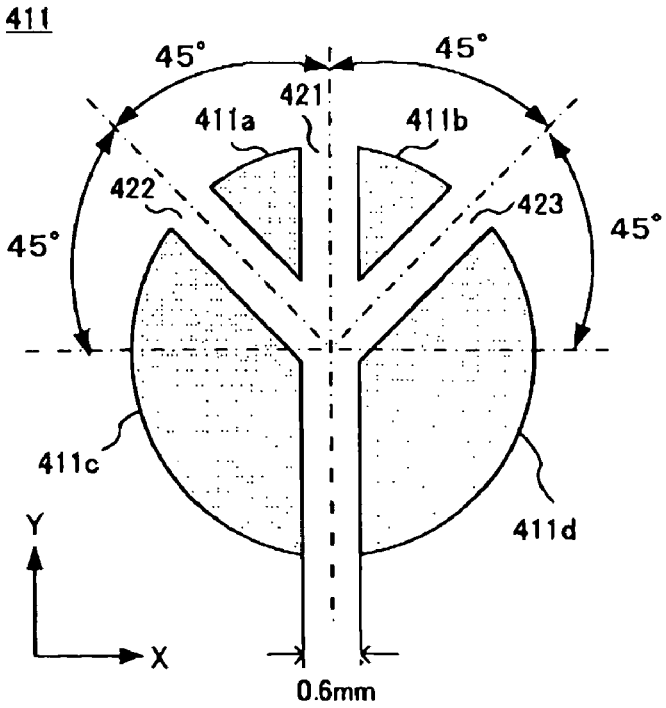
FIG. 5 shows a structure of a contact pattern 411.

FIG. 5 shows a structure of the contact pattern 411 seen from the above. As shown in FIG. 5, the contact pattern 411 comprises four contact lands 411*a* to 411*d* which are formed so as to be separate from each other. Also, the contact pattern 411 is, in its entirety, in a shape of a circle. The circle is formed such that the center thereof is positioned so as to face the center of a corresponding circular conductive rubber 31. Next, positions at which the four contact lands 411*a* to 411*d* are formed (i.e., the shape of the contact pattern) will be described. First, the contact lands are formed such that a gap (a portion where a contact land is not formed, i.e., nonconductive portion) 421 (hereinafter, referred to as a first gap) is formed along an axis direction (Y-axis direction in the case of FIG. 5) of a detection direction of the contact pattern 411 (up direction in the case of FIG. 5). In the present embodiment, the first gap 421 has a width of 0.6 mm. Further, the contact lands are formed such that a gap 422 (hereinafter, referred to as a second gap) and a gap 423 (hereinafter, referred to as a third gap) are respectively formed at positions of 45 degrees with respect to the detection direction of the contact pattern 411 (up direction in FIG. 5). To be more specific, the contact lands are formed such that gaps each having a width of 0.6 mm are formed, which gaps have the centers thereof at the positions of 45 degrees. Further, the contact lands are formed such that the first gap 421, the second gap 422 and the third gap 423 are connected at the center of the contact pattern 411 (i.e., at a position facing the center of the corresponding conductive rubber 31). In other words, in the contact pattern 411 which is circle-shaped in its entirety, the contact lands are formed so as to be divided into two portions with respect to the axis direction (Y-axis direction in FIG. 5) of the detection direction of the contact pattern 411 (up direction in the case of FIG. 5), and the contact lands are further formed so as to have such a shape that half portions thereof at a detection direction side (upper half portions in FIG. 5) are each divided at 45 degrees with respect to the detection direction of the contact pattern 411.

Figure 6:
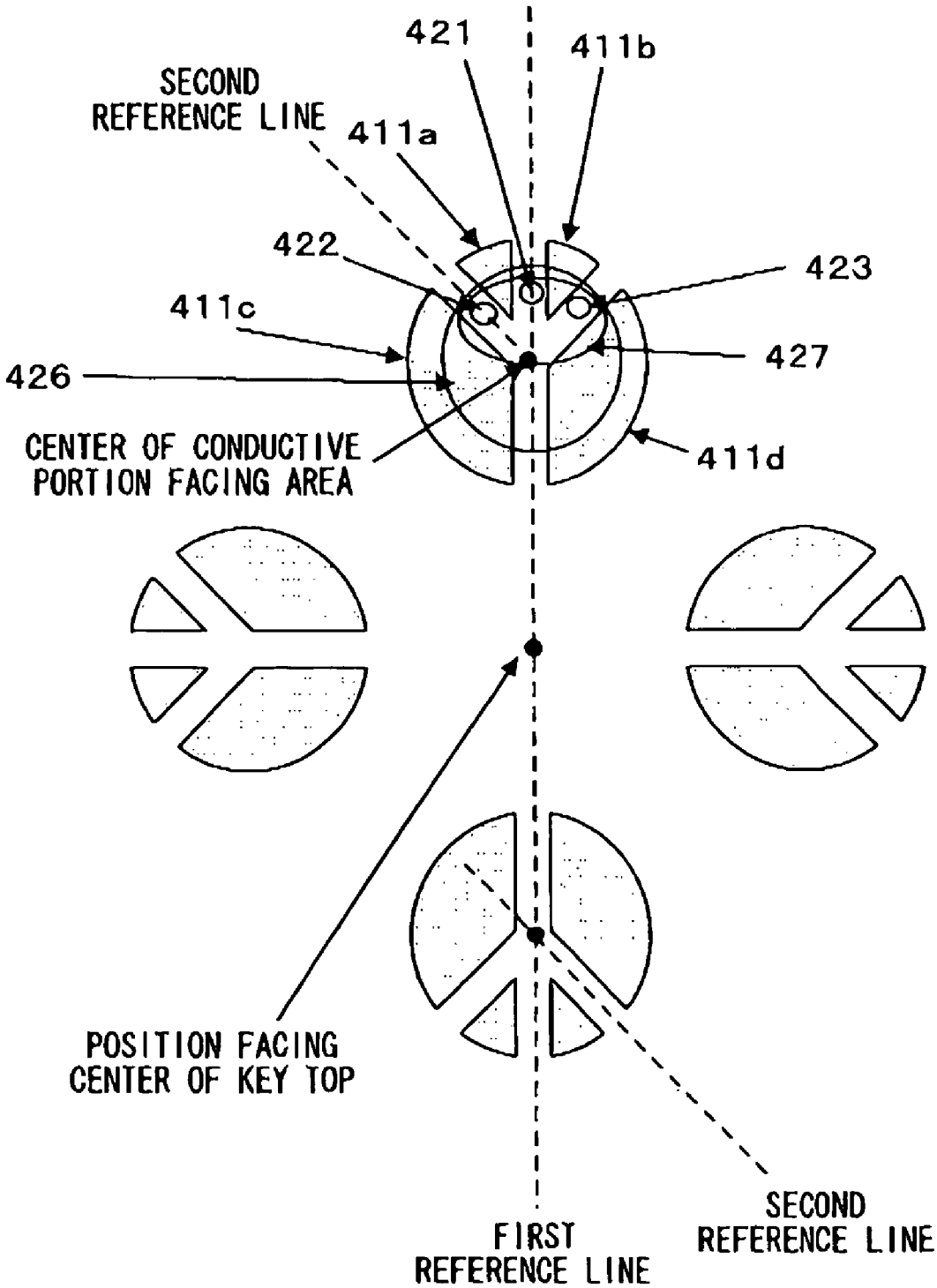
FIG. 6 is a diagram for illustrating a structure of the contact pattern 411.

A further description in relation to the shape of the contact pattern is given below with reference to FIG. 6. In FIG. 6, the contact pattern 411 has four separate lands 411*a* to 411*d* within a conductive portion facing area 426 which is an area facing the corresponding conductive rubber 31. In the contact pattern, a contact land 411*a* (hereinafter, referred to as a first land) and a contact land 411*b* (hereinafter, referred to as a second land) are provided so as to be separated by the first gap 421 provided on a first reference line which extends from a position facing the center of the key top in the direction of the center of the conductive portion facing area. Further, the second gap 422 is provided on a second reference line extending from the center of the conductive portion facing area 426 in a direction which forms, with the first reference line, a predetermined angle between 30 degrees and 60 degrees (45 degrees in the present embodiment). In a similar manner, the third gap 423 is provided at a symmetrical position to the second gap 422 with respect to the first reference line. Further, a contact land 411*c* (hereinafter, referred to as a third land), which is separated from the first land 411*a* by the second gap 422, is provided. Still further, a contact land 411*d* (hereinafter, referred to as a fourth land), which is separated from the second land 411*b* by the third gap 423, is provided. In other words, these lands are formed such that an outer area 427, which is positioned at a far side, of the conductive portion facing area 426, as seen from the position facing the center of the key top, is divided into four portions.

Figure 7:
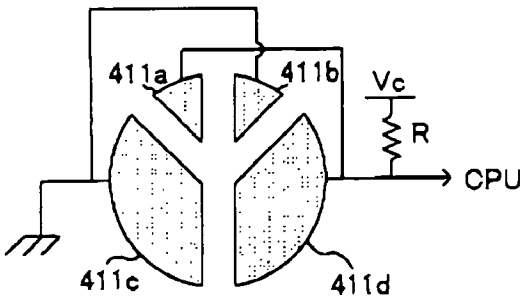
FIG. 7 shows a structure of a key switch circuit.

FIG. 7 shows a structure of a key switch circuit using a structure of the contact pattern 411 shown in FIGS. 5 and 6. In the case of using the contact pattern 411 of FIGS. 5 and 6 as a key switch, a single resistor R is connected to the first land 411*a* and the fourth land 411*d* formed on the print substrate 4. Then, a voltage level at the first land 411*a* is monitored by a CPU which is not shown, and a variation in the voltage level is detected, whereby ON or OFF of the switch is recognized. To be specific, the voltage level is Vc when the switch is OFF, and the voltage level is 0 when the switch is ON.

Figure 8:
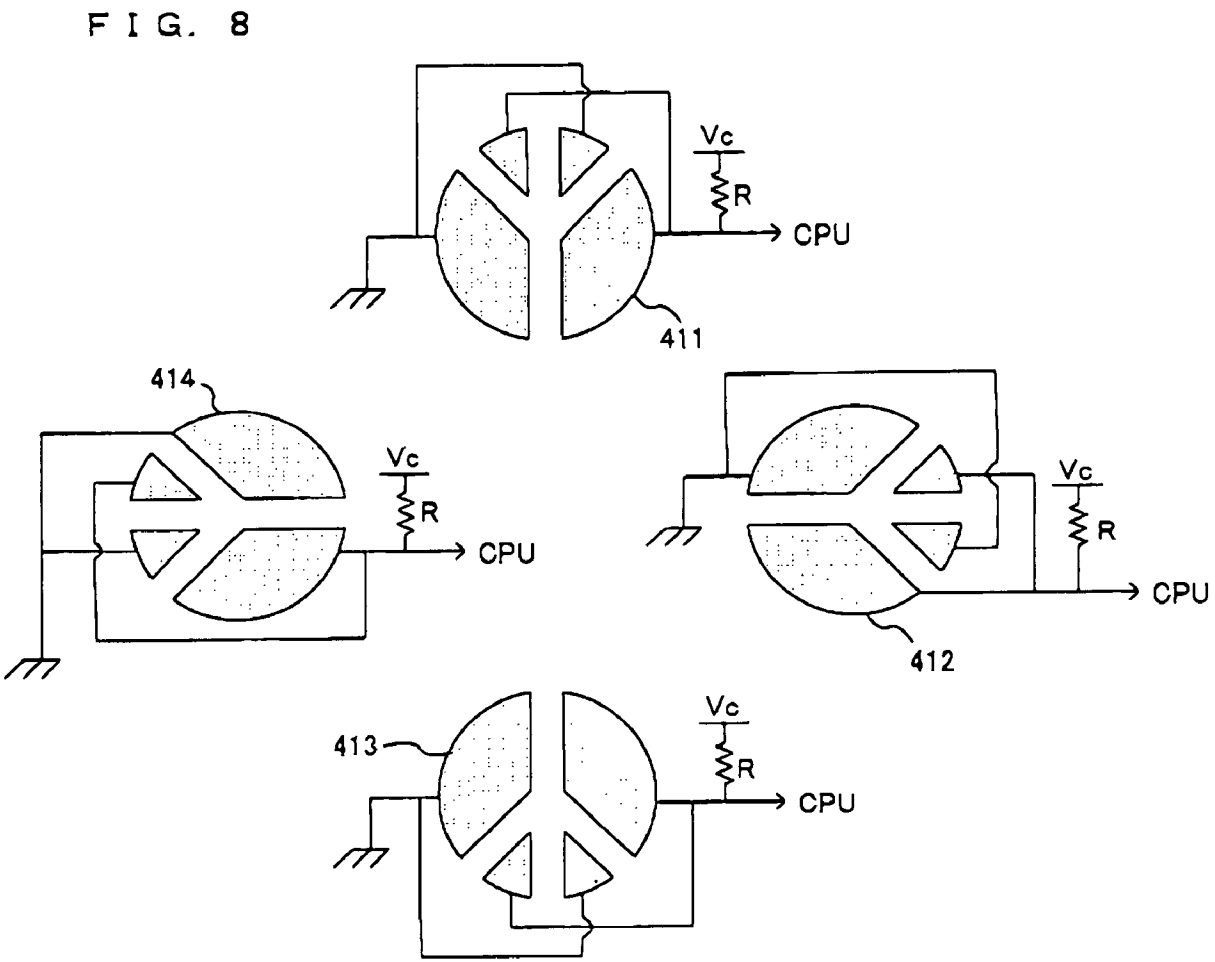
FIG. 8 shows structures of key switch circuits.
Figure 9:
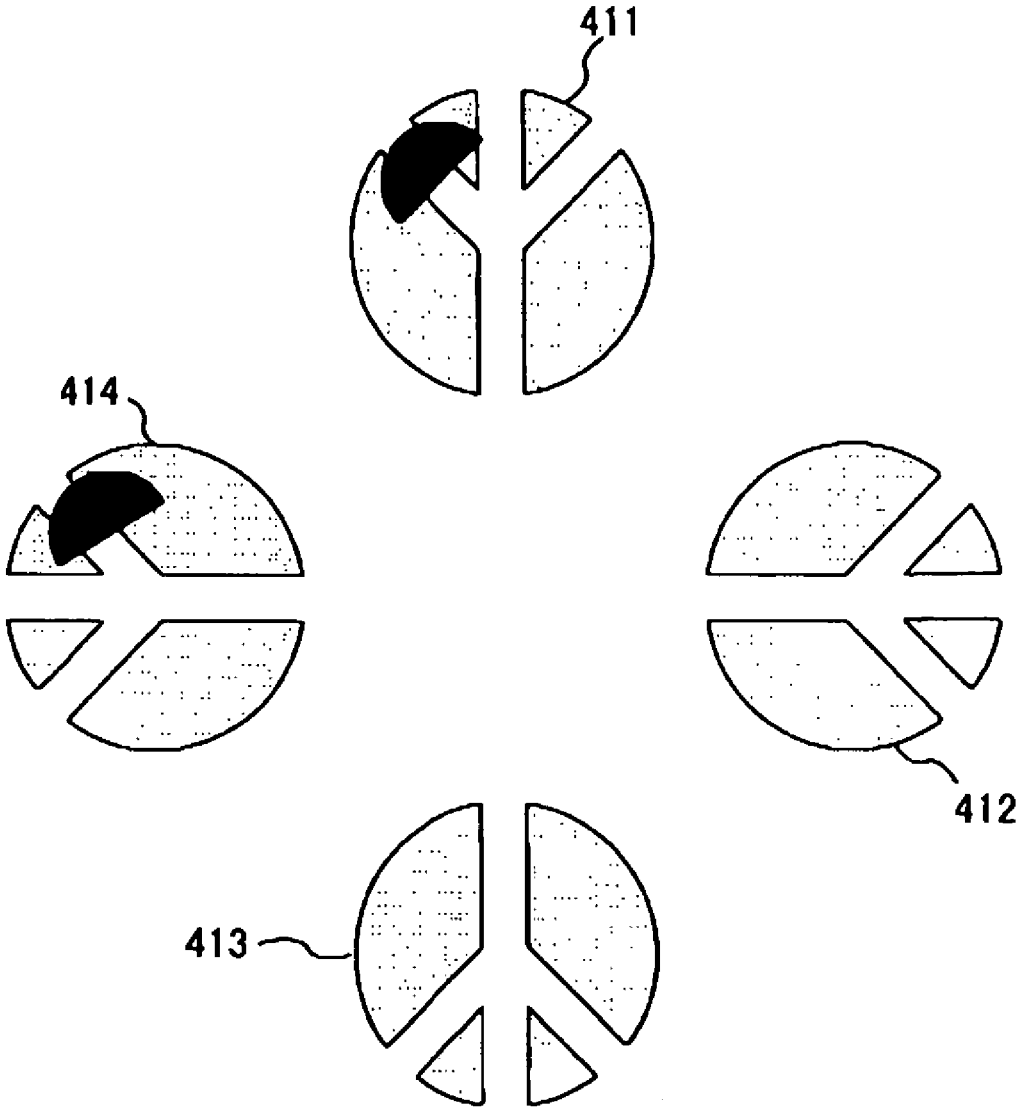
FIG. 9 shows areas contacted by conductive rubbers 31.

In the circuit structure of FIG. 7, when the conductive rubber 31 contacts the first land 411*a* and the fourth land 411*b* in a straddling manner, the circuit of the contact pattern 411 is brought into conduction. As a result, a state of the switch of the circuit of the contact pattern 411 is detected as ON. Also, when the conductive rubber 31 contacts the first land 411*a* and the third land 411*c* in a straddling manner, the circuit is brought into conduction and the switch is turned on. Further, when the conductive rubber 31 contacts the second land 411*b* and the fourth land 411*d* in a straddling manner, the circuit is brought into conduction and the switch is turned on. The contact patterns 41 as shown in FIG. 4 each have this circuit structure. FIG. 8 shows structures of key switch circuits using the structures of the four contact patterns 41 shown in FIG. 4. By having the structures shown in FIG. 8, detection of a diagonal direction input can be more precisely performed. For example, if a pressing force is weak when diagonally upper left is pressed, areas of contact patterns, which areas are contacted by conductive rubbers 31, are small. FIG. 9 shows an example of the areas contacted by the conductive rubbers 31 in the case where the pressing force is weak. Even in such a case, by using the structures of the present embodiment, the circuits of the contact patterns 411 and 414 are brought into conduction. As a result, ON inputs are detected at the circuits of both the contact patterns, and thereby an input of the up direction and an input of the left direction are detected at the same time. This allows an input of the diagonally upper left direction to be detected.

As described above, according to the present embodiment, a pressing operation performed on a position between two contact patterns, such as an input of a diagonal direction or the like, can be more precisely detected. In other words, an input of a diagonal direction or the like performed with a weak pressing force, which is difficult to detect by a conventional technique, can be more precisely detected.

Figure 11:
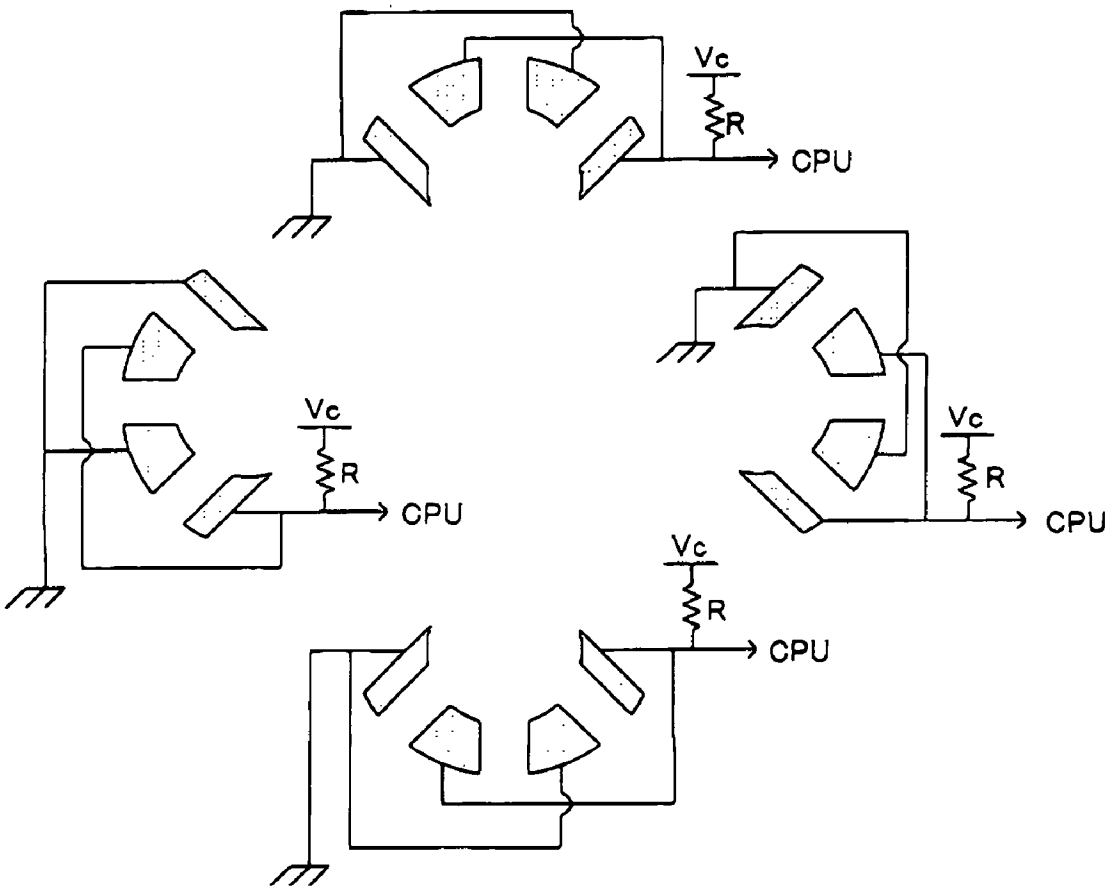
FIG. 11 shows structures of key switch circuits.
Figure 10:
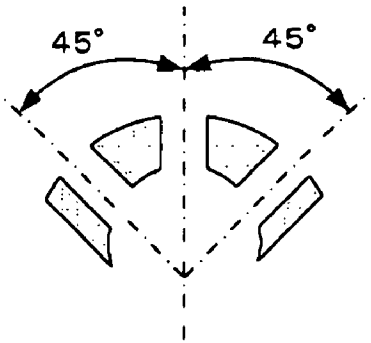
FIG. 10 shows an example of a contact pattern.

Note that, the shapes of the contact patterns are not limited to those shown in FIGS. 4 to 6. For example, each contact pattern may have such a shape as shown in FIG. 10 in which contact lands are provided only at a detection direction side of said each contact pattern. In such a case, each contact pattern is preferred to be formed so as to have gaps at positions of 45 degrees with respect to a detection direction. FIG. 11 shows structures of key switch circuits using the contact pattern shown in FIG. 10. A detailed description thereof will be omitted since the structures of the circuits are the same as the circuit structures described above with reference to FIG. 8 except for the difference in the shapes of the contact patterns.

Figure 12:
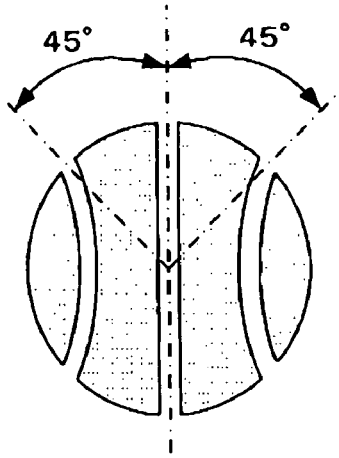
FIG. 12 shows an example of a contact pattern.
Figure 13:
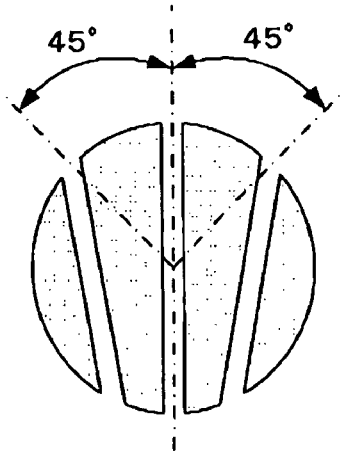
FIG. 13 shows an example of a contact pattern.
Figure 14:
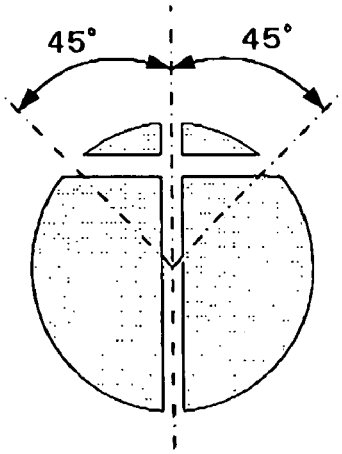
FIG. 14 shows an example of a contact pattern.
Figure 15:
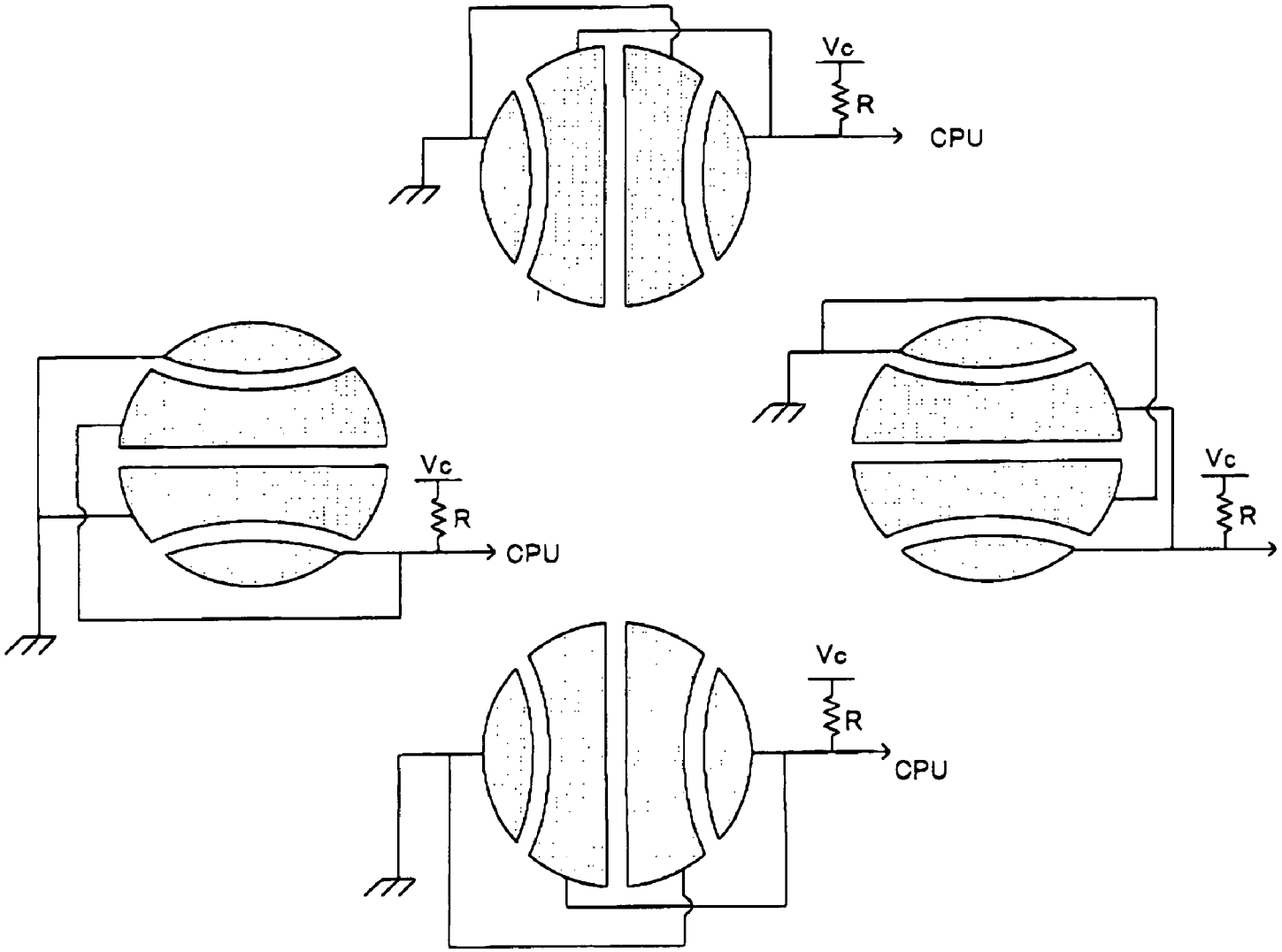
FIG. 15 shows structures of key switch circuits.
Figure 16:
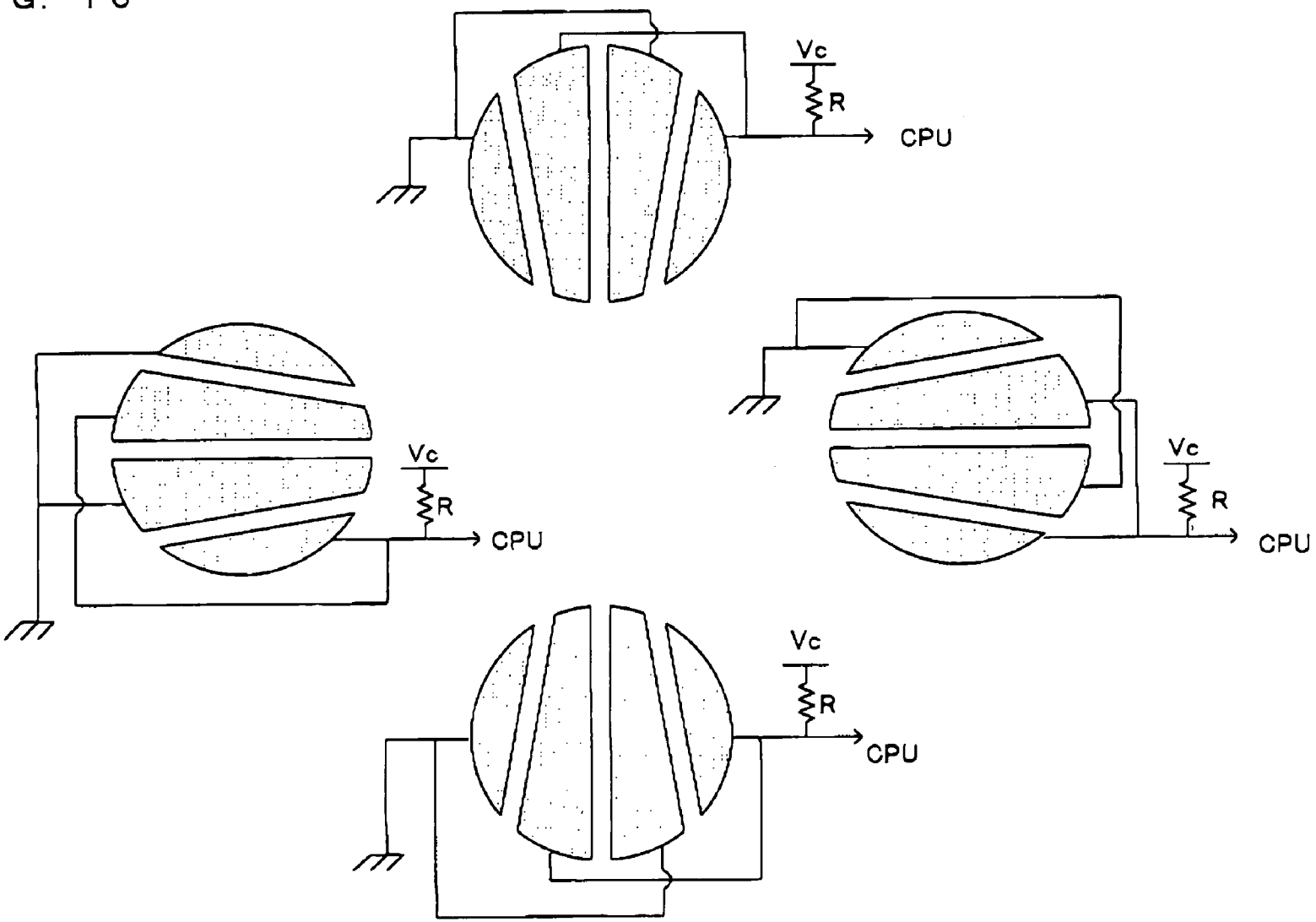
FIG. 16 shows structures of key switch circuits.
Figure 17:
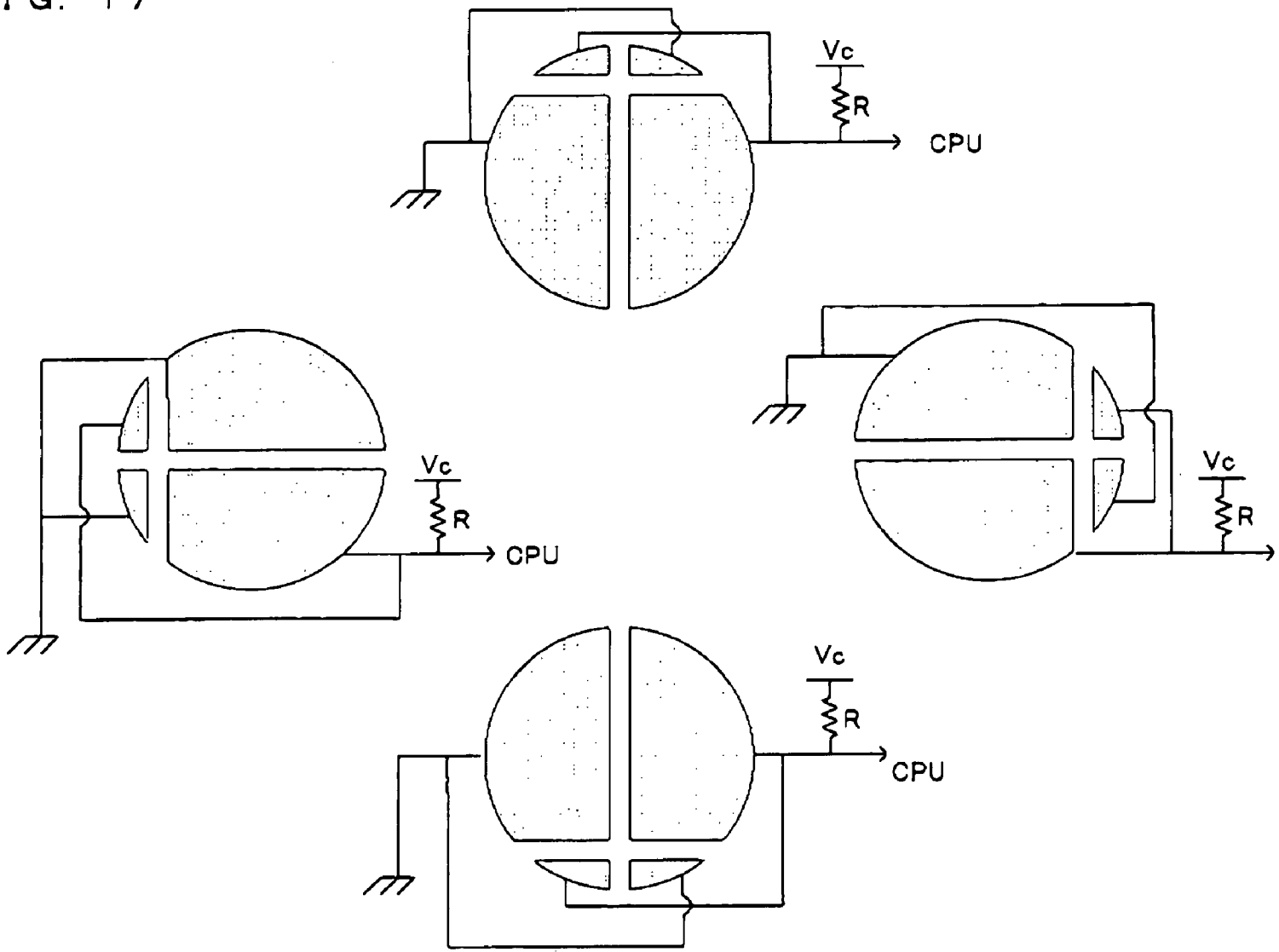
FIG. 17 shows structures of key switch circuits.
Figure 18:
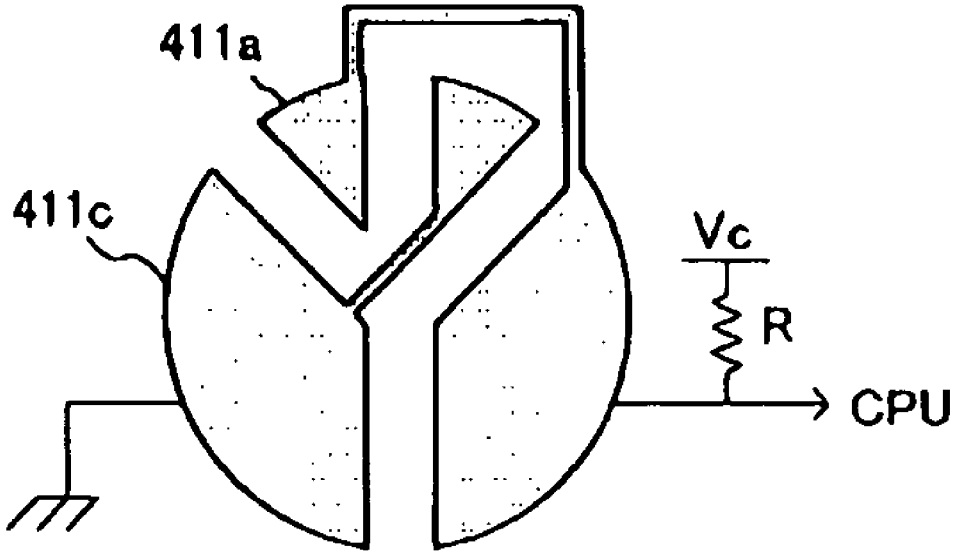
FIG. 18 shows a structure of a key switch circuit.

Further, the contact patterns may have a shape as shown in FIG. 12, FIG. 13 or FIG. 14 as long as the contact patterns are each formed so as to have a single gap along an axis of a detection direction and have such gaps as described above at both sides of the single gap (preferably, at positions of 45 degrees with respect to the detection direction). Any of the contact patterns shown in FIGS. 12 to 14 allows a pressing input of a diagonal direction as described above to be easily detected. FIGS. 15 to 17 show structures of key switch circuits using the contact patterns shown in FIGS. 12 to 14, respectively. Detailed descriptions thereof will be omitted since fundamental structures of the circuits are the same as the circuit structures described above with reference to FIG. 8 except for the difference in the shapes of the contact patterns. Further, the contact patterns may have a shape in which the first land 411*a* and the fourth land 411*d* as shown in FIG. 5 are connected and the second land 411*b* and the third land 411*c* are also connected. FIG. 18 shows an example of a contact pattern having such a shape, and shows a circuit structure thereof.

Figure 19:
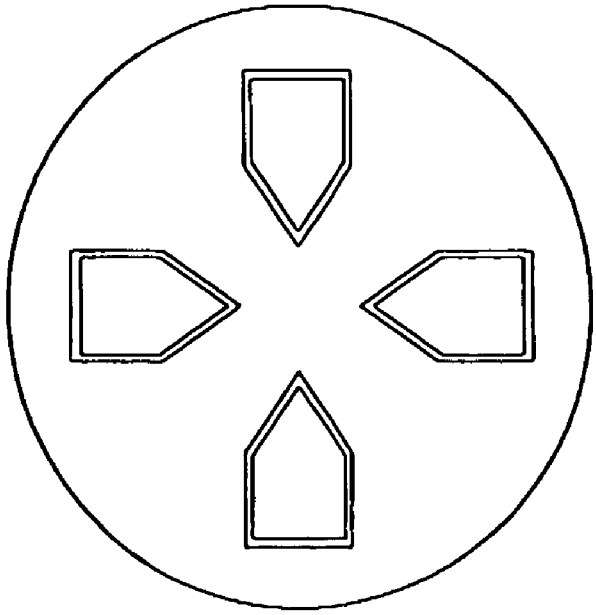
FIG. 19 shows an example of a key top.
Figure 20:
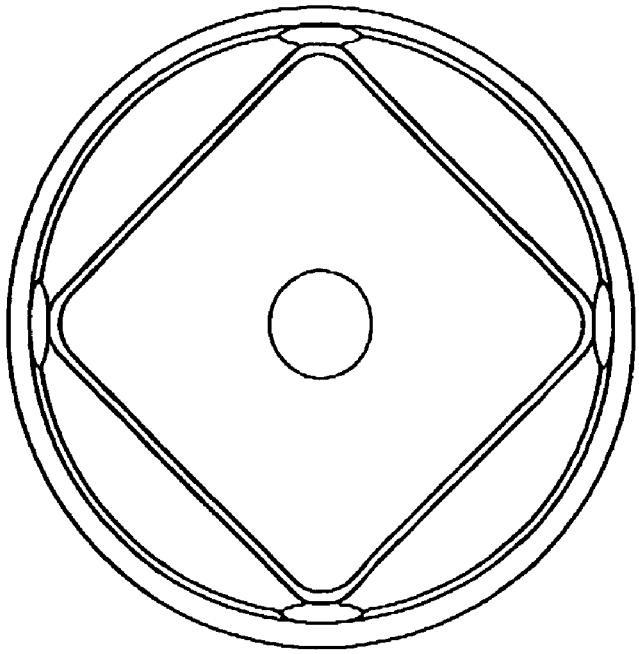
FIG. 20 shows an example of a key top.
Figure 21:
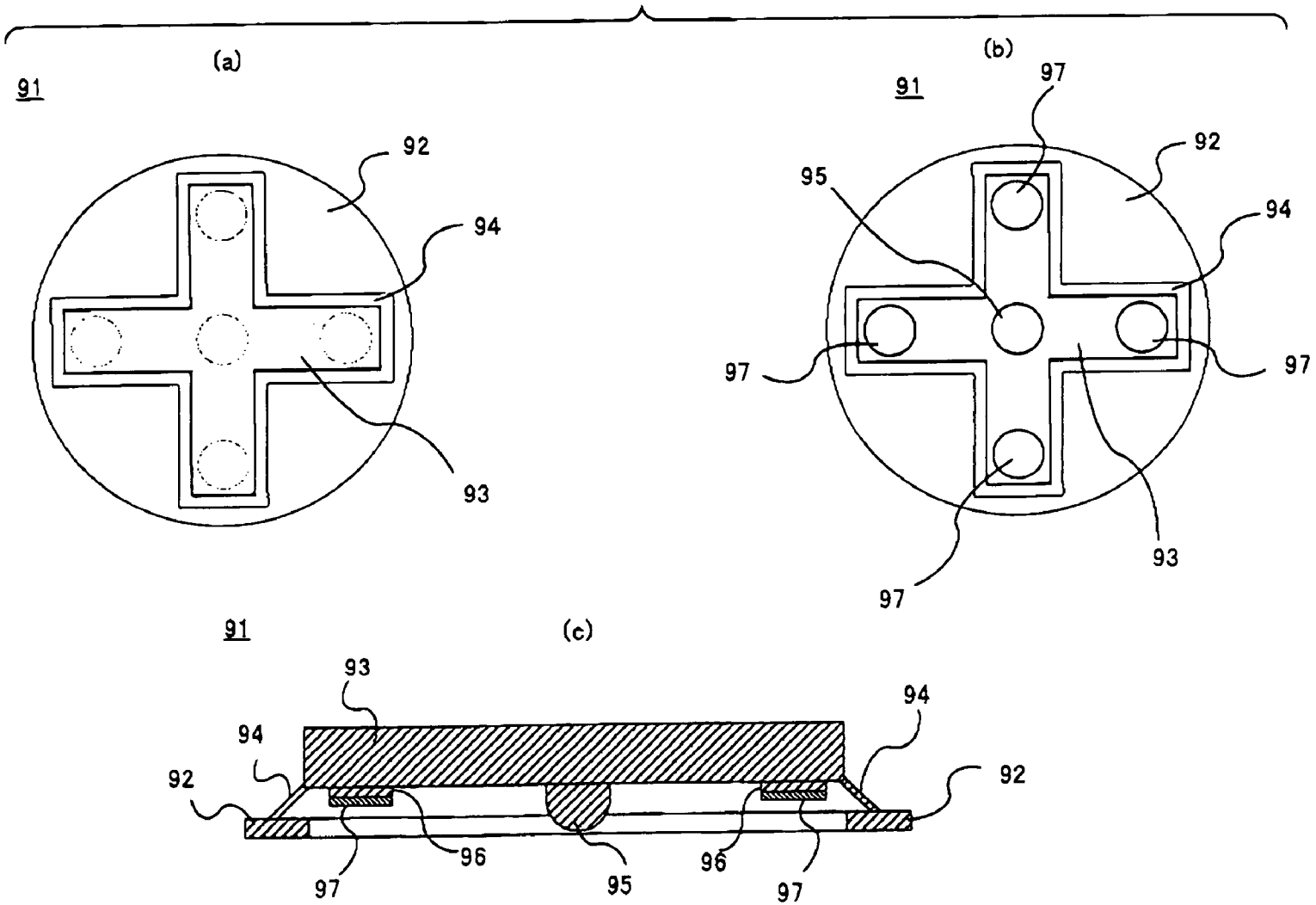
FIG. 21 shows a movable rubber contact of a conventional cross-key switch.
Figure 22:
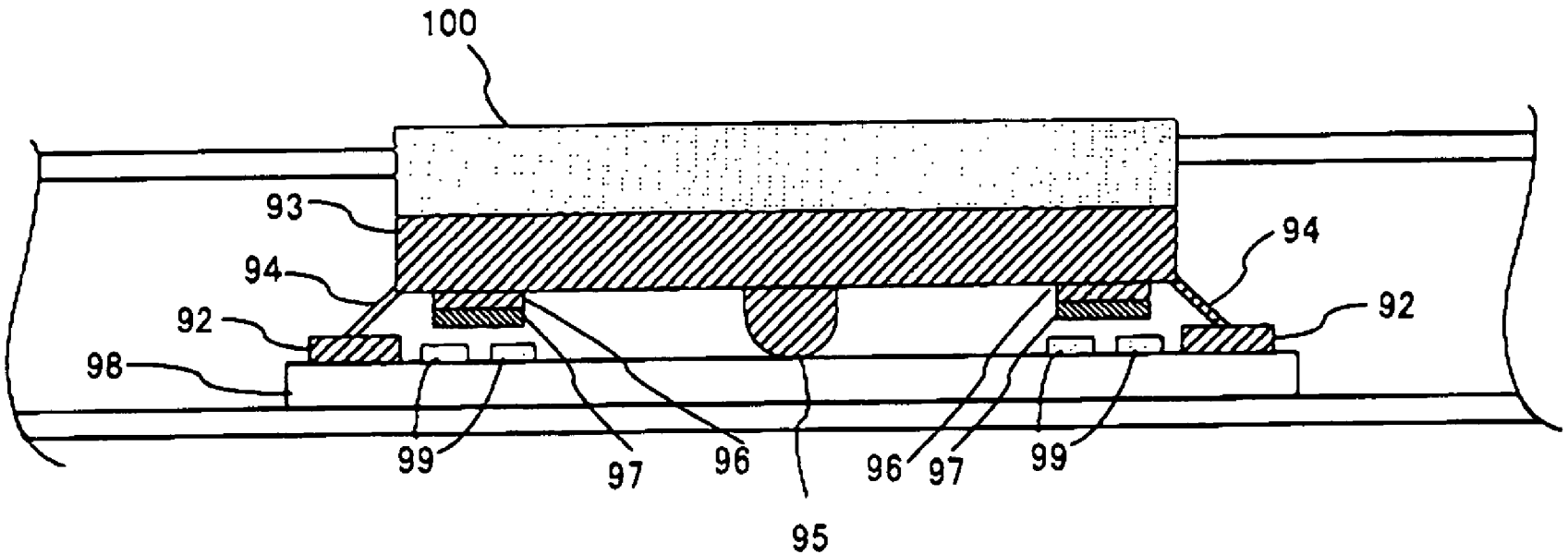
FIG. 22 is a local cross-sectional view of a controller including the movable rubber contact.

Still further, the shape of the key top 2 is not limited to the cross shape As shown in FIG. 19, the key top 2 may have such a shape that direction input buttons are independently provided for up, down, left and right directions, respectively. Also, the key top 2 may have an approximately circular shape as shown in FIG. 20.

Still further, the above embodiment gives an example of the key switch, in which the key switch using a four-way switch circuit is described. However, the contact patterns as described above may be applied to a key switch using a three-way switch (three-direction switch) circuit or eight-way switch (eight-direction switch) circuit. Also in this case, a direction input performed toward a position between contacts can be precisely detected.

While the example embodiment presented herein has been described in detail, the foregoing description is in all aspects illustrative and not restrictive. It is understood that numerous other modifications and variations can be devised without departing from the scope of the example embodiment.

What is claimed is:

1. A key switch comprising: a key top; a plurality of conductive portions which are respectively positioned in dispersed directions from a center of the key top; and a plurality of contact patterns provided on a print substrate, which are respectively provided in conductive portion facing areas respectively facing the conductive portions, which key switch is capable of detecting conduction caused by a contact between any one of the contact patterns and a corresponding one of the conductive portions which faces said any one of the contact patterns, the contact patterns each having at least four separate lands in a corresponding one of the conductive portion facing areas, and the at least four lands including: a first sector-shaped land and a second sector-shaped land which are separated by a first gap provided on a first reference line which extends from a position facing the center of the key top in a direction of a center of the corresponding one of the conductive portion facing areas; a third sector-shaped land which is separated from the first sector-shaped land by a second gap provided at a position which is distant from the first reference line in one direction; and a fourth sector-shaped land which is separated from the second sector-shaped land by a third gap provided at a position which is distant from the first reference line in another direction, wherein the key switch detects a direction input by identifying which sector-shaped lands of said contact patterns are brought into contact with said conductive portions.

2. The key switch according to claim 1, wherein the second gap is provided on a second reference line extending from the center of the corresponding one of the conductive portion facing areas in a direction which forms, with the first reference line, a predetermined angle between 30 degrees and 60 degrees.

3. The key switch according to claim 2, wherein the predetermined angle is 45 degrees.

4. The key switch according to claim 1, wherein the first gap is an area which extends along the first reference line.

5. The key switch according to claim 1, wherein the second gap is an area which extends along the second reference line.

6. The key switch according to claim 1, wherein the at least four lands are formed such that an outer area, which is positioned at a far side, of the corresponding one of the conductive portion facing areas, as seen from the position facing the center of the key top, is divided into at least four portions.

7. The key switch according to claim 1, wherein the second gap and the third gap are provided in symmetrical positions with respect to the first reference line.

8. An input device having a key switch comprising: a key top; a plurality of conductive portions which are respectively positioned in dispersed directions from a center of the key top; and a plurality of contact patterns provided on a print substrate, which are respectively provided in conductive portion facing areas respectively facing the conductive portions, which key switch is capable of detecting conduction caused by a contact between any one of the contact patterns and a corresponding one of the conductive portions which faces said any one of the contact patterns, the contact patterns each having at least four separate lands in a corresponding one of the conductive portion facing areas, and the at least four lands including: a first sector-shaped land and a second sector-shaped land which are separated by a first gap provided on a first reference line which extends from a position facing the center of the key top in a direction of a center of the corresponding one of the conductive portion facing areas; a third sector-shaped land which is separated from the first sector-shaped land by a second gap provided at a position which is distant from the first reference line in one direction; and a fourth sector-shaped land which is separated from the second sector-shaped land by a third gap provided at a position which is distant from the first reference line in another direction, wherein the key switch detects a direction input by identifying which sector-shaped lands of said contact patterns are brought into contact with said conductive portions.

9. A key switch comprising: a key top; a plurality of conductive portions which are respectively positioned in dispersed directions from a center of the key top; and a plurality of contact patterns provided on a print substrate, which are respectively provided in conductive portion facing areas respectively facing the conductive portions, which key switch is capable of detecting conduction caused by a contact between any one of the contact patterns and a corresponding one of the conductive portions which faces said any one of the contact patterns, the contact patterns each having, in an outer area which is positioned at a far side, of the corresponding one of the conductive portion facing areas, as seen from a position facing the center of the key top, at least a plurality of gaps and a plurality of sector-shaped lands which are separated from each other by the plurality of gaps, wherein the key switch detects a direction input by identifying which sector-shaped lands of said contact patterns are brought into contact with said conductive portions.

10. The key switch according to claim 9, wherein the contact patterns each have at least three gaps provided therein, and a first gap is provided on a first reference line extending from the position facing the center of the key top in a direction of a center of the corresponding one of the conductive portion facing areas, such that the first gap is divided by the first reference line, and a second gap and a third gap are provided at both sides of the first gap.

11. A key switch comprising: a key top; a plurality of conductive portions which are respectively positioned in dispersed directions from a center of the key top; and a plurality of contact patterns provided on a print substrate, which are respectively provided in conductive portion facing areas respectively facing the conductive portions, which key switch is capable of detecting conduction caused by a contact between any one of the contact patterns and a corresponding one of the conductive portions which faces said any one of the contact patterns, the contact patterns each having a set of sector-shaped lands which are separate from each other so as to be brought into conduction when the key top is pressed at a position at which a corresponding one of the conductive portions is present, and a set of sector-shaped lands which are separate from each other so as to be brought into conduction when the key top is pressed at a position between the plurality of conductive portions, wherein the key switch detects a direction input by identifying which sector-shaped lands of said contact patterns are brought into contact with said conductive portions.

12. Contact patterns respectively provided in conductive portion facing areas respectively facing a plurality of conductive portions respectively positioned in dispersed directions from a center of a key top, the contact patterns each having at least four separate lands in a corresponding one of the conductive portion facing areas, and the at least four lands including: a first sector-shaped land and a second sector-shaped land which are separated by a first gap provided on a first reference line which extends from a position facing the center of the key top in a direction of a center of the corresponding one of the conductive portion facing areas; a third sector-shaped land which is separated from the first sector-shaped land by a second gap provided at a position which is distant from the first reference line in one direction; and a fourth sector-shaped land which is separated from the second sector-shaped land by a third gap provided at a position which is distant from the first reference line in another direction, wherein the key switch detects a direction input by identifying which sector-shaped lands of said contact patterns are brought into contact with said conductive portions.

* * * * *